US011554072B2

(12) United States Patent
Roman

(10) Patent No.: US 11,554,072 B2
(45) Date of Patent: Jan. 17, 2023

(54) SMART SENSOR CANE

(71) Applicant: Carmelo Roman, New Britain, CT (US)

(72) Inventor: Carmelo Roman, New Britain, CT (US)

(73) Assignee: Carmelo Roman, New Britain, CT (US)

( * ) Notice: Subject to any disclaimer, the term of this patent is extended or adjusted under 35 U.S.C. 154(b) by 71 days.

(21) Appl. No.: 16/593,293

(22) Filed: Oct. 4, 2019

(65) Prior Publication Data

US 2021/0128394 A1 May 6, 2021

Related U.S. Application Data

(60) Provisional application No. 62/741,581, filed on Oct. 5, 2018.

(51) Int. Cl.
*A61H 3/06* (2006.01)

(52) U.S. Cl.
CPC ..... *A61H 3/068* (2013.01); *A61H 3/061* (2013.01); *A61H 2201/5092* (2013.01)

(58) Field of Classification Search
None
See application file for complete search history.

(56) References Cited

U.S. PATENT DOCUMENTS 6,948,937 B2 9/2005 Tretiakoff et al.
7,627,451 B2 12/2009 Vock et al.
7,668,588 B2 2/2010 Kovacs
7,920,066 B2 4/2011 Troxler
8,200,320 B2 6/2012 Kovacs
2003/0163287 A1 8/2003 Vock et al.
(Continued)

FOREIGN PATENT DOCUMENTS

WO 2002093272 A1 11/2002
WO 2018084816 A2 5/2018

OTHER PUBLICATIONS

"Introducing the Revolutionary Smart Cane WeWALK." Cool Blind Tech. https://coolblindtech.com.introducing-the-revolutionary-smart-cane-wewalk/. May 12, 2018, 4 pages.
(Continued)

*Primary Examiner* — Thomas S McCormack
(74) *Attorney, Agent, or Firm* — McCarter & English, LLP

(57) ABSTRACT

The present invention relates to a smart sensor cane for blind people. The smart sensor cane comprise of a processing unit, a surrounding data collection unit, a front data collection unit. The Processing unit further comprise of a solar panel, a slot for GSM module, a speaker unit, a height adjustment control unit, a battery unit and a microcontroller. The surrounding data collection unit further comprise of plurality of sensors and plurality of red led strobe light. The front data collection unit further comprise of plurality of LASER sensors, metal tip and led signal light. The microcontroller in the present invention is connected to the plurality of sensor, the LASER, the solar panel, the slot for GSM module, the speaker unit, and the height adjustment control unit, the battery unit. The GSM module is connect between the microcontroller to mobile objects and cloud server.

12 Claims, 9 Drawing Sheets

(56) References Cited

U.S. PATENT DOCUMENTS

| | | | | |
|---|---|---|---|---|
| 2006/0166740 | A1 | 7/2006 | Sufuentes | |
| 2007/0208232 | A1 | 9/2007 | Kovacs | |
| 2008/0251110 | A1* | 10/2008 | Pede | A61H 3/068 701/532 |
| 2010/0154850 | A1* | 6/2010 | Schulz | A45B 9/02 135/65 |
| 2015/0070479 | A1* | 3/2015 | Yu | A45B 9/04 348/62 |
| 2017/0172462 | A1 | 6/2017 | Alghazi | |
| 2017/0216125 | A1* | 8/2017 | Hyde | A61B 5/14551 |
| 2018/0356233 | A1* | 12/2018 | Baqain | H04M 3/4936 |
| 2019/0307633 | A1 | 10/2019 | Ceylan | |

OTHER PUBLICATIONS

Andrew Tortman, "Access granted: Helping people with disabilities explore the places they love," Microsoft News, https://news.microsoft.com/en-gb/features/access-granted-helping-people-with-disabilities-explore-their-places-they-love , Jun. 4, 2019, 10 pages.

"Facts and Figur . . . ", American Foundation for the Blind, www.afb.org, Undated, 2 pages.

"Facts and Figures on Adults with Vision Loss", American Foundation for the Blind, https://www.afb.org/research-and-initiatives/statistics/adults, Mar. 2019, retrieved from Internet Archive Wayback Machine, https://web.archive.org/web/20190610235838/https://www.afb.org/research-and-initiatives/statistics/adults on Mar. 3, 2021, 5 pages.

"Blindness Statistics," National Federation of the Blind, https://www.nfb.org/resources.blindness-statistics, printed Jul. 11, 2014, 6 pages.

* cited by examiner

SMART SENSOR CANE

CROSS REFERENCE TO RELATED APPLICATIONS

Not applicable

FEDERALLY SPONSORED RESEARCH AND DEVELOPMENT

Not applicable

MICROFICHE

Not applicable

(1) FIELD OF THE INVENTION

The present invention generally relates to the field mobility cane for blind people. The invention, more particularly the present invention relates to a smart sensor cane for blind people.

(2) BACKGROUND OF THE INVENTION

The domestic environment is having various types of obstacles, hurdles or stumbling block that we face in our day to day life. Moreover, some obstacles present a great danger for a person such as a descending stair case or protruding objects that may cause injuries. Eyesight is the most important part of human physiology to get information from the outside world or environment as 83% of information from the environment human gets by vision for performing many of the activity of daily living. The traditional and the oldest method for person with visual impairment are the walking cane. A Cane is used to facilitate walking for fashion, safety or for comfort reasons. It come in many shape and size and can be sought by the collectors. Some kind of walking stick may be used as by people with disability. It is used by many people who are blind or visually impaired.

With the help of cane, a blind or visually impaired person scan their surroundings for obstacles, hurdles or stumbling block, but is also helpful for other traffic participants in identifying the user as blind or visually impaired and taking appropriate care. Cane length depends upon the height of a user, and traditionally extends from the floor to the user's sternum. The white cane is commonly accepted as the symbol of blindness that is the individual has a visual impairment and two red bands added it indicates that the user is blind as well as deaf.

The electronic Cane with advance technology allows visually challenged people to navigate with ease, also provides overall measures, object detection and send information to the blind people. With the help the advance technology cane user or the blind people get ease to face the environment or the outside world and this type of advance cane is replacing the traditional walking cane.

A number of different types of tools and techniques is used for designing the Sensor Cane are available in the prior art.

Prior art document U.S. Pat. No. 4,280,204A discloses a conventional mobility cane for the blind incorporates a compact, dual-mode, ultrasonic obstacle detection sensor that includes a combination of transmitting and receiving. In one mode, the sensor warns of low lying objects that might contact the upper extremities of an ambulatory mobility cane user. In another mode, the user can determine the presence or absence of more remote objects. Means are provided for readily alternating between said object sensor modes. But the device is unable to indicate other traffic participants in identifying the user as blind.

Another prior art document CN203075151U discloses an infrared detection device that is installed at the bottom of the stick handle, an alarm prompter is arranged at the top of the stick handle, the walking stick for the blind man is telescopic, a sleeved mouth is designed in the middle of the stick handle, and a light emitting diode (LED) lamp is arranged on the alarm prompter. The infrared detection device can detect barriers, anti jamming capacity is strong, and when the barriers exist in the front, a warning sound is sent out through the alarm prompter. When the walking stick is not used, the thin portion at the bottom of the walking stick can be retracted to the thick portion at the upper portion of the walking stick through the sleeved mouth, and the walking stick for the blind man is convenient to store. The LED lamp is arranged on the alarm prompter, when the blind man goes out at night, the lamp can be opened, and other people can notice the blind man easily so that risks can be avoided. But the device is absence of rechargeable solar panel.

Prior art document U.S. Pat. No. 5,331,990A discloses a safety cane incorporates an ambient light sensitive illumination device for conserving battery power. A tipping detector is also incorporated which sounds an audible alarm after a first time delay. If the cane is not retrieved by the end of the second time delay, the cane broadcasts an initiating instruction to a telephone dialing device. But the device does not contain any personnel information about the user.

Prior art document CN201399069Y discloses a multifunctional guide-stick for blind people is characterized in that a switch I and a switch II are arranged on a handle of the stick for guiding blind people, a solar panel is arrange that the upper part of a vertical stick body, an emergency lamp is arranged in the middle, a radio is arranged at the lower part, and a luminous material layer is coated on the outer surface of the blind guiding stick; the switch I, the emergency lamp and the solar panel are connected in series; and the switch II, the radio and the solar panel are connected in series as well. But the device is unable to adjust the height according to the user also not providing any charging alarm.

Prior art document CN107666168A discloses a charging dock cane, by providing a public good wireless charging cradle cane, the cane blind stack charging dock proximity wireless charging can be realized; for convenience charging cane, the cane is provided in the radio base charge a fixing structure cane, the cane can be fixed by a fixing structure. Voice prompts provided in a wireless charging cradle cane, the visually impaired can hear voice prompts find public wireless charging cradle. But the device is unable to alarm the user about the obstacles.

Prior art document CN106074099A discloses a system comprises a walking stick, glasses, a cloud server and a mobile terminal, the walking stick is in wireless connection with the glasses through Bluetooth, and the glasses and the mobile terminal are connected with the cloud server through a wireless network. The walking stick and the glasses are held by the blind person, provide obstacle avoiding and guiding service for the blind person and meanwhile can position the blind person and upload the position information to the cloud server. A map is stored in the cloud server, a navigation route can be provided for a blind user according to the set starting point, and meanwhile the real-time position of the blind user can be stored according to certain coding. The mobile terminal is held by a guardian of the blind user, can load the position of the corresponding user from the cloud server according to the coding and timely positions the blind use. But the device is unable to indicate other traffic participants in identifying the user as blind.

Another Prior art document CN202086735U discloses a utility model that relates to the technical field of blind guiding equipment, in particular to a multifunctional blind guiding cane, which comprises a cane body and a handle connected with the cane body, wherein the cane body comprises at least two sections of telescopic and foldable main body canes; a radar is arranged in the cane body; one end of the radar is electrically connected with a rechargeable battery; the other end of the radar is electrically connected with a light-emitting diode (LED); the other end of the LED is electrically connected with a light dependent resistor; and a radar probe is arranged outside the cane body. But the device will be expensive as well as it does not contain any personnel information about the user.

However, above mentioned references and many other similar references has one or more of the following shortcomings: (a) expensive; (b) complex device; (c) requirement of the more power supplies; (d) unable to adjust height; (e) unable to provide personal information about the user; (f) Absence of alarming system;

and short comings with regard to providing a sensor cane for blind or visually impacted people.

(3) SUMMARY OF THE INVENTION

In the view of the foregoing disadvantages inherent in the known types of cane for blind people present in the prior art, the present invention provides an improved smart sensor cane for blind people. As such, the general purpose of the present invention, which will be described subsequently in greater detail, is to provide a new and improved sensor cane which has all the advantages of the prior art and none of the disadvantages.

The main aspect of the present invention is to provide a smart sensor cane for blind people. A smart sensor cane for blind people comprise of a processing unit, a surrounding data collection unit, a front data collection unit. The Processing unit further comprise of a solar panel, a slot for GSM module, a speaker unit, a height adjustment control unit, a battery unit and a microcontroller. The surrounding data collection unit further comprise of plurality of sensors and plurality of red led strobe light. The front data collection unit further comprise of plurality of LASER sensors, metal tip and led signal light. At least two connectors, where connectors further comprise of connector-1 and connector-2. The connector-1 and connector-2 connects between processing unit and the surrounding data collection unit and surrounding data collection unit and the front data collection unit respectively.

Another aspect of the present invention is to provide the battery unit which is further comprise of docking unit and plurality of battery. The solar panel convert solar energy to electricity and supply electricity to the plurality battery. The plurality battery unit supply electricity to the microcontroller and microcontroller supply required electricity to the sensors.

Another aspect of the present invention is to provide the GSM module which connects between the microcontroller to mobile objects and cloud server.

Still another aspect of the present invention is to provide the plurality of sensors in the surrounding data collection unit and LASER sensors in a front data collection unit collects surrounding information and front obstacle in 180 degree information respectively and delivers to the microcontroller. The led signal light blink when laser sensors detect obstacle. The metal tip is used for sensing the walking floor of the user.

Another aspect of the present invention is to provide the height adjustment control unit which is used to control the height of the sensor cane. The connector-1 and connector-2 is used to increase or decrease the length of the sensors cane.

Still another aspect of the present invention is to provide the red led strobe light used as the indicator to the surrounding people.

Another aspect of the present invention is to provide a the microcontroller which is connected to the plurality of sensor, the LASER, the solar panel, the slot for GSM module, the speaker unit, and the height adjustment control unit, the battery unit.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty which characterize the invention, are pointed out with particularity in the disclosure. For a better understanding of the invention, its operating advantages and the specific objects attained by its uses, reference should be had to the accompanying drawings and descriptive matter in which there are illustrated preferred embodiments of the invention.

(4) BRIEF DESCRIPTION OF THE DRAWINGS

The invention will be better understood and objects other than those set forth above will become apparent when consideration is given to the following detailed description thereof. Such description makes reference to the annexed drawings wherein.

(5) DETAILED DESCRIPTION OF THE INVENTION

Figure 1:
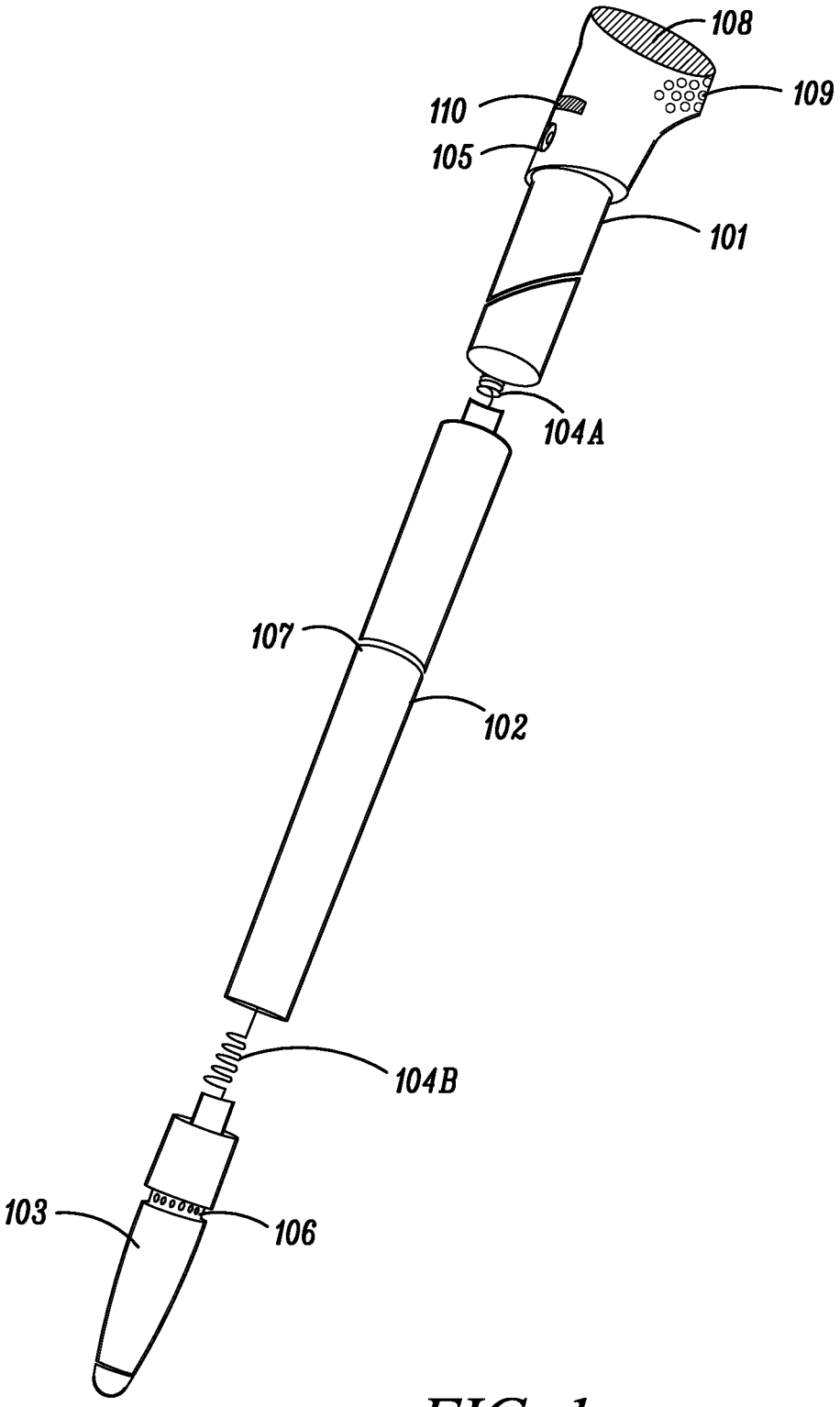
FIG. 1 depicts the schematic diagram of the sensor cane.

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that the embodiments may be combined, or that other embodiments may be utilized and that structural and logical changes may be made without departing from the spirit and scope of the present invention. The following detailed description is, therefore, not to be taken in a limiting sense, and the scope of the present invention is defined by the appended claims and their equivalents.

The present invention is described in brief with reference to the accompanying drawings. Now, refer in more detail to the exemplary drawings for the purposes of illustrating non-limiting embodiments of the present invention.

As used herein, the term "comprising" and its derivatives including "comprises" and "comprise" include each of the stated integers or elements but does not exclude the inclusion of one or more further integers or elements.

As used herein, the singular forms "a", "an", and "the" include plural referents unless the context clearly dictates otherwise. For example, reference to "a device" encompasses a single device as well as two or more devices, and the like.

As used herein, the terms "for example", "like", "such as", or "including" are meant to introduce examples that further clarify more general subject matter. Unless otherwise specified, these examples are provided only as an aid for understanding the applications illustrated in the present disclosure, and are not meant to be limiting in any fashion.

As used herein, the terms—may", "can", "could", or "might" be included or have a characteristic, that particular component or feature is not required to be included or have the characteristic.

Exemplary embodiments will now be described more fully hereinafter with reference to the accompanying drawings, in which exemplary embodiments are shown. These exemplary embodiments are provided only for illustrative purposes and so that this disclosure will be thorough and complete and will fully convey the scope of the invention to those of ordinary skill in the art. The invention disclosed may, however, be embodied in many different forms and should not be construed as limited to the embodiments set forth herein.

Various modifications will be readily apparent to persons skilled in the art. The general principles defined herein may be applied to other embodiments and applications without departing from the spirit and scope of the invention. Moreover, all statements herein reciting embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure). Also, the terminology and phraseology used is for the purpose of describing exemplary embodiments and should not be considered limiting. Thus, the present invention is to be accorded the widest scope encompassing numerous alternatives, modifications and equivalents consistent with the principles and features disclosed. For purpose of clarity, details relating to technical material that is known in the technical fields related to the invention have not been described in detail so as not to unnecessarily obscure the present invention.

Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims.

All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Various terms as used herein are shown below. To the extent a term used in a claim is not defined below, it should be given the broadest definition and persons in the pertinent art have given that term as reflected in printed publications and issued patents at the time of filing.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all groups used in the appended claims.

The present invention relates to a smart sensor cane for blind people. The smart sensor cane provided in the present invention can be used for giving direction to the blind people. The design of smart sensor cane is chosen because of its simple structure and improvement of the existing sensor cane for blind people.

The main embodiment of the present invention is to provide a smart sensor cane 100 for blind people. FIG. 1 shows the schematic diagram of the smart sensor cane 100. The smart sensor cane 100 for blind people comprise of a processing unit 101, a surrounding data collection unit 102, a front data collection unit. The Processing unit 101 further comprise of a solar panel 108, a slot for GSM module/card 110, a speaker unit 109, a height adjustment control unit 105, a battery unit and a microcontroller. The surrounding data collection unit 102 further comprise of plurality of sensors and plurality of red led strobe light 107. The front data collection unit 103 further comprise of plurality of LASER sensors 302, metal tip 303 and led signal light 301. The battery unit in the present invention further comprise of docking unit and plurality of battery. The solar panel 108 converts solar energy to electricity and supply electricity to the plurality battery. The plurality battery unit supply electricity to the microcontroller and microcontroller supply required electricity to the sensors. The microcontroller in the present invention is connected to the plurality of sensor, the LASER, the solar panel 108, the slot for GSM module 110, the speaker unit 109, and the height adjustment control unit 105, the battery unit. The GSM module is connect between the microcontroller to mobile objects and cloud server. The mobile objects in the present invention include smart phone, mobile, personnel computer, tablet, laptop and any kind of mobile device. The height adjustment control unit 105 is used to control the height of the sensor cane. The user can extent the height of the smart sensor cane 100 clicking on the height adjustment control unit 105, and can shorten the height of the smart sensor cane 100 by using the height adjustment control unit 105. The personal information of the user and any other relevant information are also saved on the GSM module/card. These information can also be used in case of an emergency situation or an accident.

The smart sensor cane also embossed with the braille language instructions, such as where turn "ON" button, and where all the elements or switches are on the smart sensor cane. The blind person can read the braille language instruction and follow the instructions.

The smart sensor cane is embedded with the hardware/electronic components, when the user turns ON the smart sensor cane. The smart sensor cane provides all instructions how to operate the cane and where all the elements are available on the cane. The smart sensor cane will work in a similar way as currently available devices in the market, such as "Google Home Mini" or "Amazon Alexa"—which are two way communicating system.

Figure 2A:
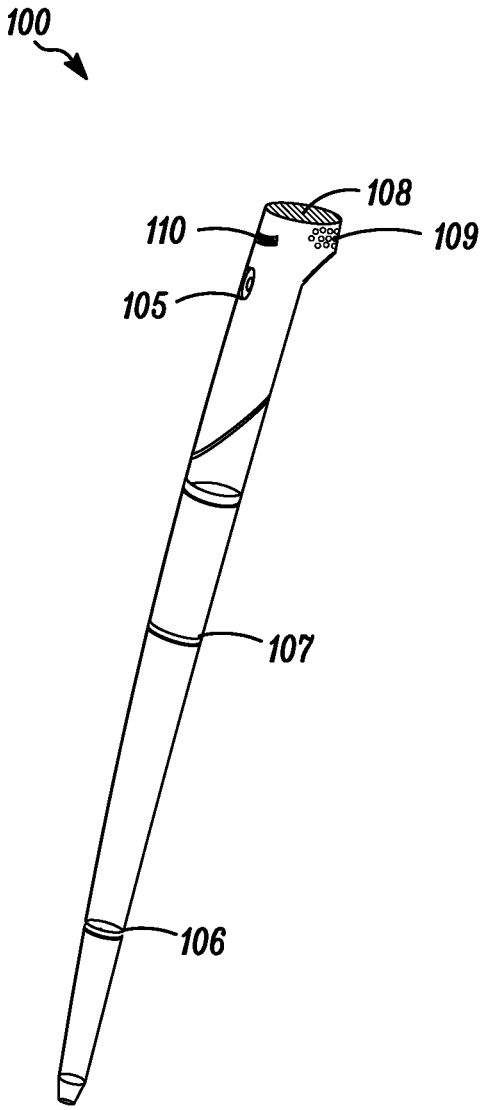
FIG. 2A depicts the schematic diagram of the sensor cane with connectors.
Figure 2B:
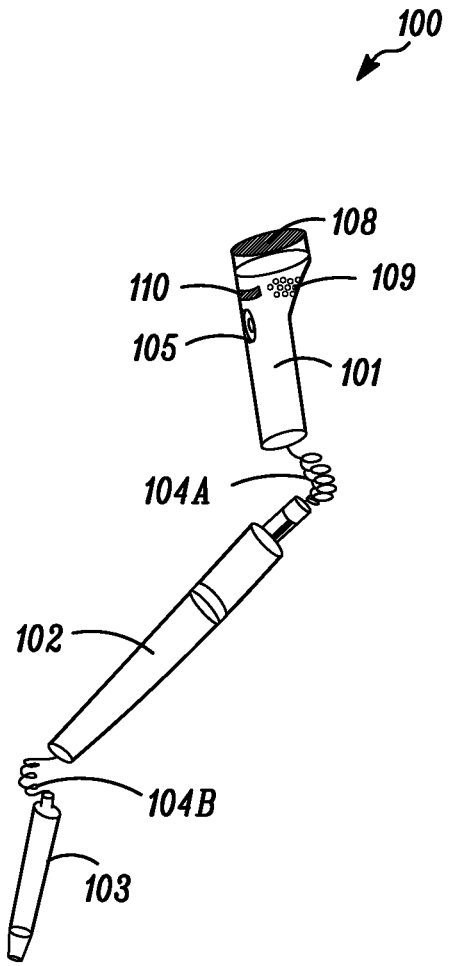
FIG. 2B depicts an exploded view of the schematic diagram of the sensor cane with connectors.

FIG. 2A and FIG. 2B show the schematic diagram of the sensor cane with connectors. The connectors further comprise of connector-1 and connector-2. The connector-1 and connector-2 connects between processing unit 101 and the surrounding data collection unit 102 and surrounding data collection unit 102 and the front data collection unit 103 respectively. The connector-1 and connector-2 is used to increase or decrease the length of the sensors cane. The connector-1 and connector-2 have sliding turret and solenoid type wiring. The sliding turret of the connector-1 is present in the surrounding data collection unit 102. The sliding turret in the connector-2 is present in the front data collection unit 103. When the user clicked on the height adjustment control unit 105 the turret in the connector-1 and connector-2 are extend to increase the length of the smart sensor cane 100. The communication of the plurality of sensor in the surrounding data collection unit 102, the LASER sensors 302 in the front data collection unit 103 with the microcontroller are through the wiring present in the solenoid type wiring.

Figure 3:
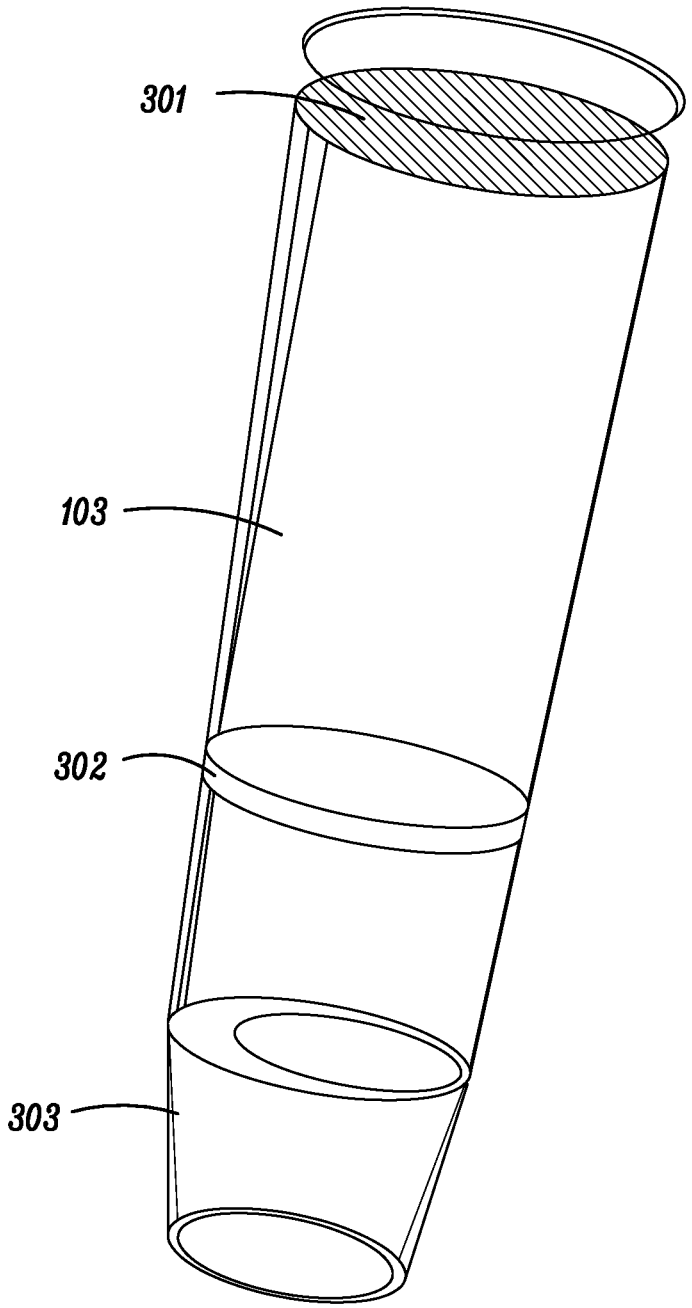
FIG. 3 depicts the schematic diagram of front data collection unit of the sensor cane.

FIG. 3 shows the schematic diagram of the front data collection unit 103 of the sensor cane. The front data collection unit 103 further comprises LASER sensors 302, led signal light and metal tip 303. The LASER sensors 302 emit light through a process of optical amplification based on the stimulated emission of electromagnetic radiation. The LASER means "Light Amplification by Stimulated Emission of Radiation." The LASER sensors 302 in the present invention emit light in 180 degree direction. Whenever there is an obstacle in front of the user of the smart sensor cane the emitted light strike and return back to the smart sensor cane 100. The LASER detects the dimension and the distance to the obstacle from the user. This information is then delivers to the microcontroller through the connector-1 and connectors2. The led signal light in the present invention blink when LASER sensors 302 detect obstacle. The led signal light use as the indicator to the surrounding people when the user interacts with any obstacle. The user in the present invention is the blind people who are using the smart sensor cane 100. The metal tip 303 in the present invention is used for sensing the walking floor of the user. There are different floor that the user may walk through such as the floor may be of soil, tiles, road concrete, finished home floor and sand etc. The metal tip 303 sense the by the roughness of the floor or sound when it strike with the floor.

Figure 4:
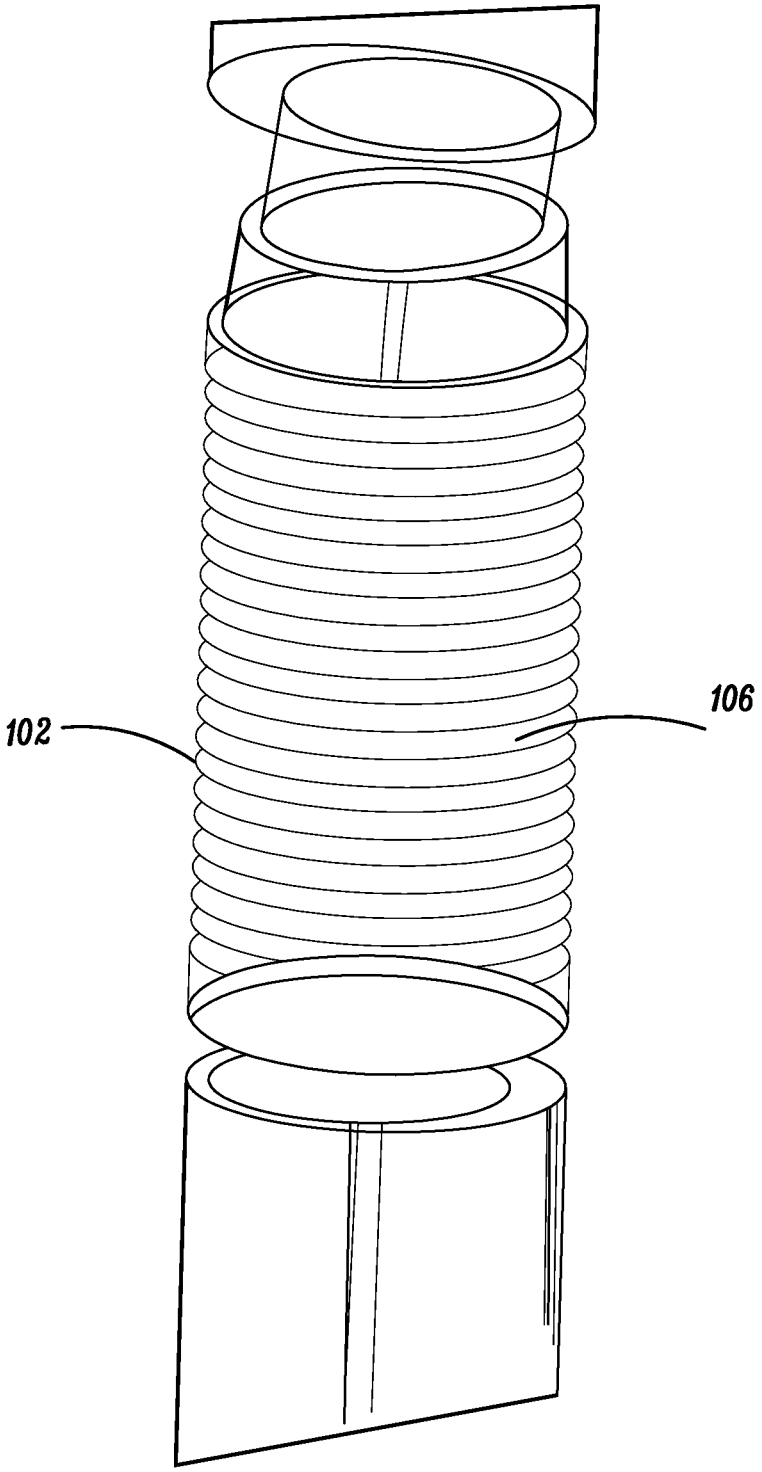
FIG. 4 depicts the schematic diagram of surrounding data collection unit of the sensor cane.

FIG. 4 shows the schematic diagram of surrounding data collection unit 102 of the sensor cane. The surrounding data collection unit 102 comprises of the red led strobe light 107 and plurality of sensors. The red led strobe light 107 used as the indicator to the surrounding people. The red led strobe light 107 blink or grow when the user passes or cross sensitive area such as road, trail line or pool. The red led strobe light 107 blinking help the surrounding people to stop there car or help the user to cross the sensitive area. The surrounding people may be in vehicle, bike, cycle or may nearby walking people. The plurality of sensors in the surrounding data collection unit 102 collects surrounding information such as vehicle, people, pool, house, trees and other natural things. The collected data by the plurality of sensors are delivers to the microcontroller in the processing unit 101 through the solenoid type wiring in the connector-1.

Figure 5:
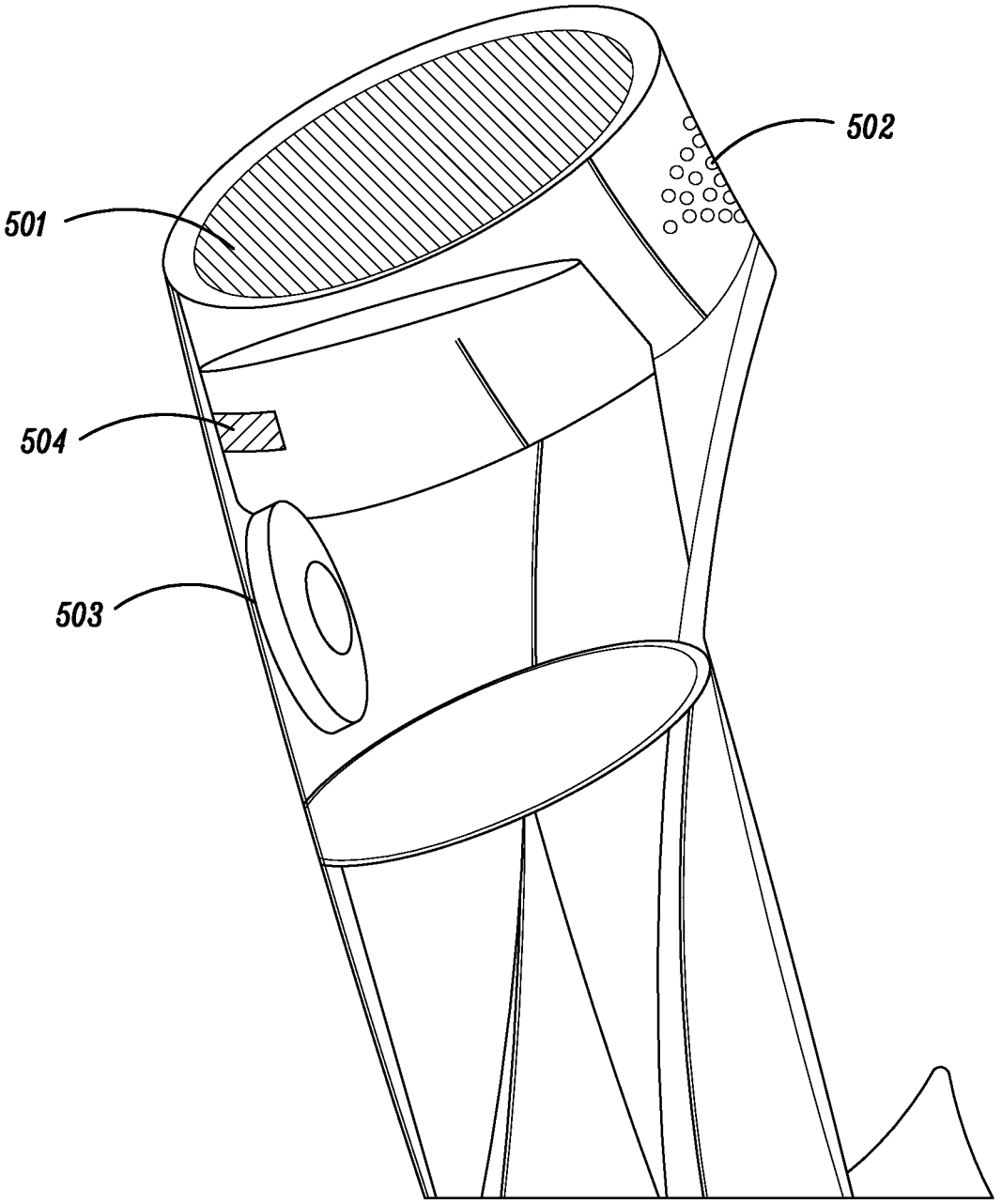
FIG. 5 depicts the schematic diagram of processing unit of the sensor cane.

FIG. 5 shows the schematic diagram of processing unit 101 of the sensor cane. The Processing unit 101 further comprise of a solar panel 108, a slot for GSM module 110, a speaker unit 109, a height adjustment control unit 105, a battery unit and a microcontroller. The solar panel 108 in the present invention collects solar energy and converts it into electricity. The converted electric energy by the solar panel 108 are store in the battery unit for later used. The battery unit in the present invention can be recharge through the solar panel 108 as well as the external electricity supply. The docking station provide the facility to connect the smart solar cane to the external electricity supply source through pluck. The slot for GSM module 110 used for connecting GSM module to the smart sensor cane 100. The GSM (Global System for Mobile communications) module is connected between the microcontroller to the mobile objects and the cloud server. The path taken by the user and the obstacle interact by the user are store for future use in the cloud server. Whenever the user walk on the same path the data are extract from the cloud server and compare it with the present obstacle to understand the path better. The GSM module also provides the exact position of the user and exact path that the user walks through. The speaker unit 109 may have one speaker or multiple speakers. The details of data collected by the surrounding data collection unit 102 and the front data collection unit 103 are converted into sound and the user can hear it through the speaker. The speaker unit 109 also may connected wirelessly with headphone that can be used by the user. The wirelessly may include Bluetooth, Wi-Fi and infra-red etc.

Figure 6:
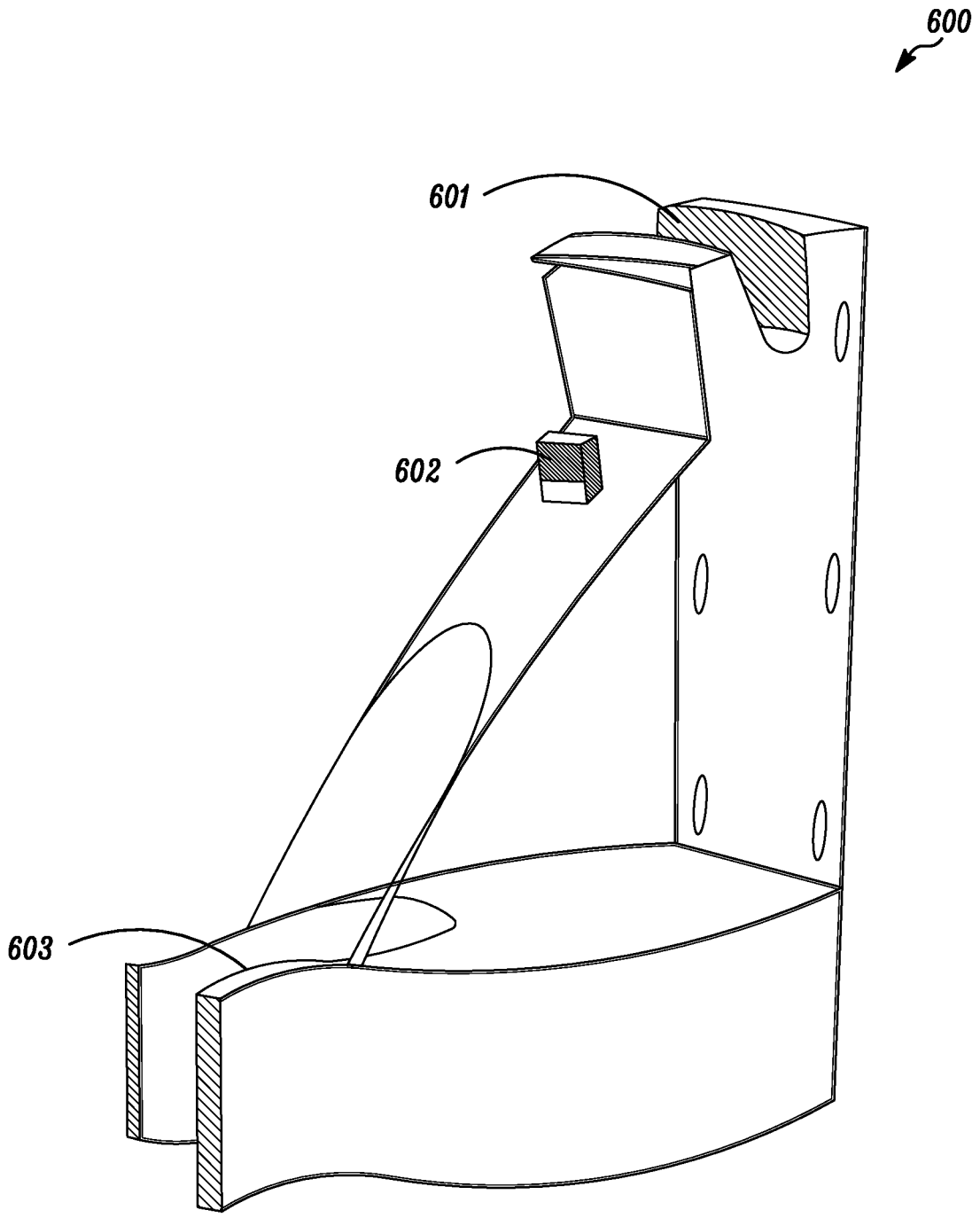
FIG. 6 depicts the schematic diagram of docking station.

FIG. 6 shows the schematic diagram of docking station. The docking station is used for facility the battery unit in connecting smart sensor cane to the external electricity supply source. The glass and or spectacles can be keeps in the docking station. The smart sensor can also keep in the docking station after used.

Figure 7:
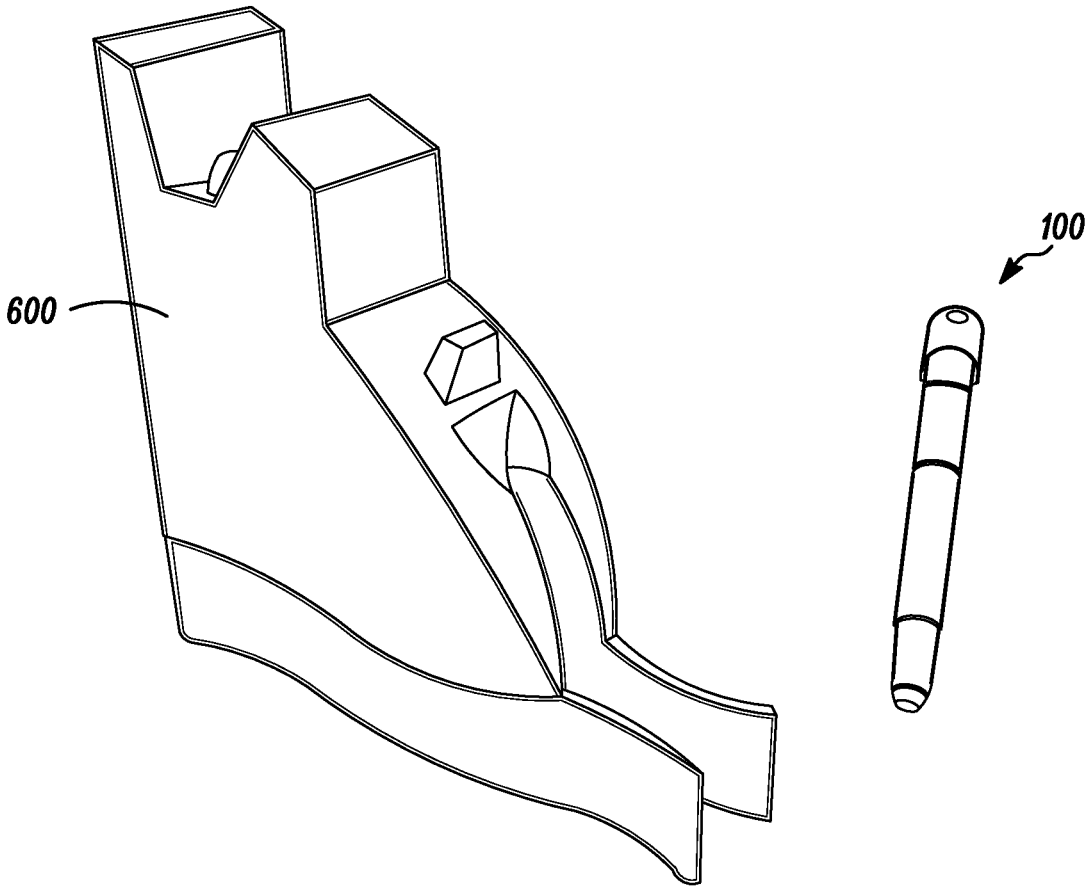
FIG. 7 depicts the schematic diagram of docking station with the smart sensor cane.
Figure 8:
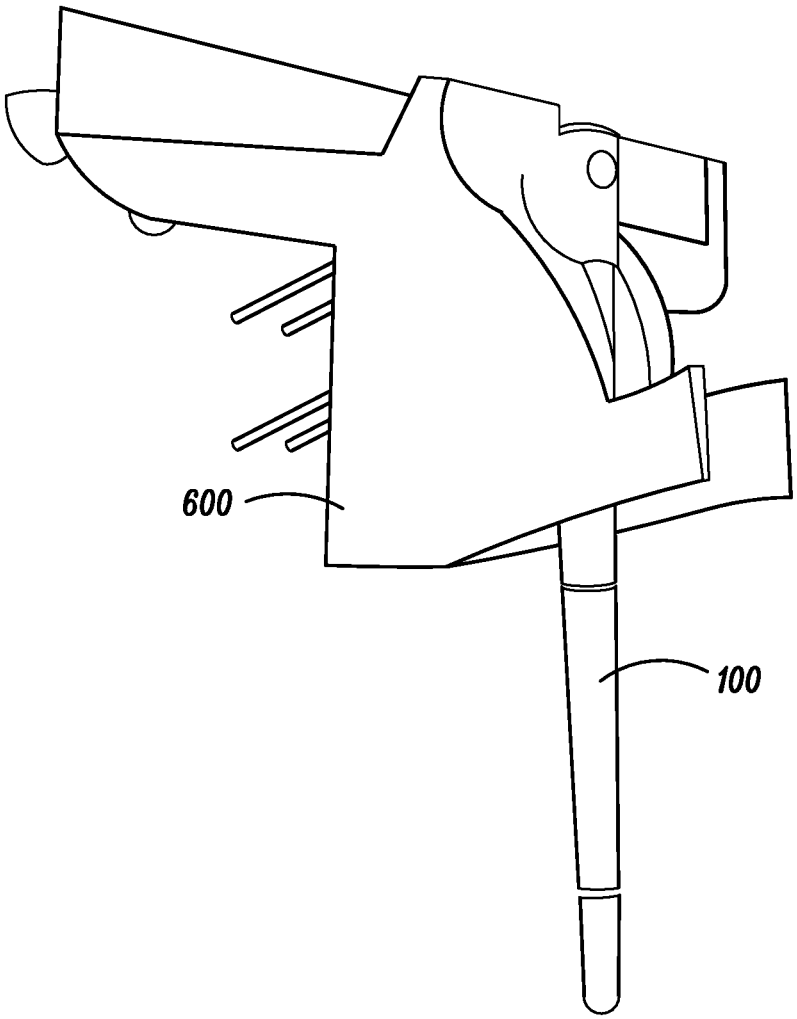
FIG. 8 depicts the schematic diagram of attachment of smart sensor cane with docking station.
Figure 9:
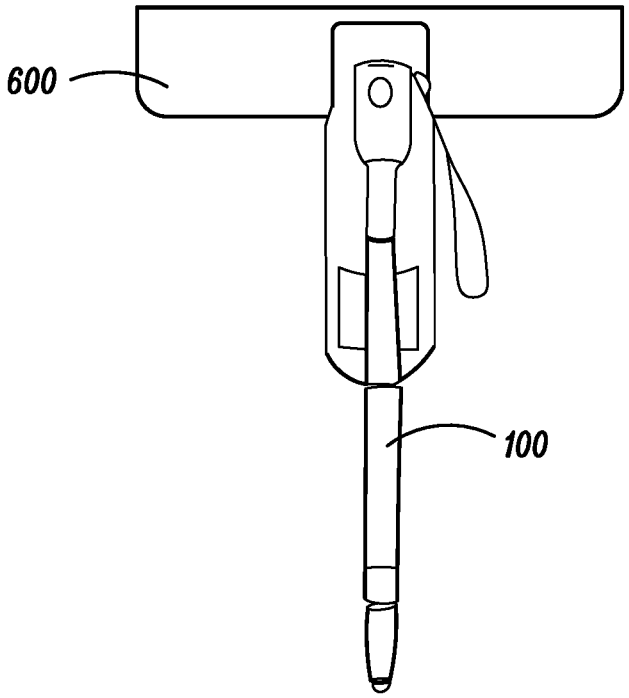
FIG. 9 depicts the schematic diagram of front view attachment of smart sensor cane with docking station.

FIG. 7 shows the schematic diagram of docking station with the smart sensor cane 100. The docking station can be hook in wall or temporarily attach with wall to keep the smart sensor cane 100 in a safe or convenient place by the user. FIG. 8 shows the schematic diagram of attachment of smart sensor cane 100 with docking station. FIG. 9 shows the schematic diagram of front view attachment of smart sensor cane 100 with docking station.

The plurality of sensors, LASER sensors 302, and metal tip 303 collects data from the external environment. These data are then transfer to the microcontroller. The battery unit supply electricity to the microcontroller. The microcontroller supply electric power to the sensors for its normal working. The data receive by the microcontroller from the plurality of sensors, LASER sensors 302, and metal tip 303 are process and take necessary action, such as blinking led signal light, red led strobe light 107 etc. When the user used the smart sensor cane 100 then they can hear about the surrounding environment and obstacle in the front continuously by the speaker unit 109 or wirelessly.

The smart sensor cane 100 in the present invention is very helpful for the people who are completely blind as well as the people who are partially blind. It brings a new revolutionary device to medical market for the blind people. By using the smart sensor cane 100 the user may walk, jog or even run without help of any second person.

It is to be understood that the above description is intended to be illustrative, and not restrictive. For example, the above-discussed embodiments may be used in combination with each other. Many other embodiments will be apparent to those of skill in the art upon reviewing the above description.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the embodiments.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention.

What is claimed is:

1. A smart sensor cane 100 for blind people comprising:

a proximal end thereof and a distal end thereof;

a processing unit 101 located at the proximal end and configured for holding by a user, and including a solar panel 108, a slot configured to receive a GSM module 110, a speaker 109, a height adjustment controller 105, a battery unit and a microcontroller;

a surrounding data collection portion 102 located distally of the processing unit and including plurality of sensors and a plurality of red strobe lights 107;

a front data collection portion 103 located distally of the surrounding data collection portion and including a plurality of LASER sensors 302, a metal tip 303 located at the distal end, and an LED signal light; and at least first and second connectors, wherein said first connector connects said processing unit 101 and said surrounding data collection portion 102, and said second connector connects said surrounding data collection portion 102 and said front data collection portion 103.

2. The smart sensor cane 100 according to claim 1, wherein said battery unit further includes a docking portion and plurality of batteries.

3. The smart sensor cane 100 according to claim 1, wherein said solar panel 108 is adapted to supply electricity to the battery unit and to said microcontroller.

4. The smart sensor cane 100 according to claim 1, further including a GSM module adapted to communicatively connect the microcontroller to mobile wireless objects and cloud servers.

5. The smart sensor cane 100 according to claim 1, wherein said height adjustment controller is adapted to control the height of the sensor cane.

6. The smart sensor cane 100 according to claim 1, wherein said connectors are adapted to alter a length of the said sensor cane.

7. The smart sensor cane 100 according to claim 1, wherein said red strobe lights are adapted to notify to surrounding people the presence of a user of the sensor cane.

8. The smart sensor cane 100 according to claim 1, wherein said plurality of sensors in the surrounding data collection portion are configured to detect objects and persons in the environment surrounding the sensor cane.

9. The smart sensor cane 100 according to claim 1, wherein said LASER sensors 302 in the front data collection portion are configured to detect an obstacle within 180 degrees of a front side of the sensor cane.

10. The smart sensor cane 100 according to claim 1, wherein said microcontroller is operatively connected to said plurality of sensors, said LASER sensors, said solar panel 108, said slot for GSM module 110, said speaker 109, said height adjustment control unit, and said battery unit.

11. The smart sensor cane 100 according to claim 9, configured to blink said LED signal light when said laser sensors 302 detect an obstacle.

12. The smart sensor cane 100 according to claim 1, wherein said metal tip 303 is configured to sense the walking floor traversed by a user.

* * * * *